United States Patent [19]

Hahn

[11] 4,381,872

[45] May 3, 1983

[54] REMOTE CONTROLLED CLAMSHELL BUCKET APPARATUS AND METHOD OF USING SAME

[75] Inventor: Oscar W. Hahn, Houston, Tex.

[73] Assignee: McGinnes Manufacturing Company, Houston, Tex.

[21] Appl. No.: 248,004

[22] Filed: Mar. 26, 1981

[51] Int. Cl.[3] ..... B66C 3/16

[52] U.S. Cl. ..... 294/70; 37/186; 294/88; 294/111

[58] Field of Search ..... 294/70, 88, 106, 107, 294/110 R, 111, 112; 37/183 R, 183 A, 184, 186–188

[56] References Cited

U.S. PATENT DOCUMENTS

| | | | |
|---|---|---|---|
| 1,535,878 | 4/1925 | Townsend | 37/186 |
| 2,188,672 | 1/1940 | Atkinson | 37/186 |
| 2,676,052 | 4/1954 | Mittry | 294/88 |
| 3,103,753 | 9/1963 | Takacs | 37/187 |
| 3,310,335 | 3/1967 | Shuey | 294/88 |
| 3,540,770 | 11/1970 | Mitchell | 294/111 |
| 3,934,917 | 1/1976 | Paxton | 294/110 R X |
| 4,043,580 | 8/1977 | Thoule | 294/111 X |
| 4,174,131 | 11/1979 | Gregg | 294/70 |

FOREIGN PATENT DOCUMENTS

| | | | |
|---|---|---|---|
| 915691 | 11/1946 | France | 294/70 |

*Primary Examiner*—Johnny D. Cherry

*Attorney, Agent, or Firm*—Pravel, Gambrell, Hewitt, Kirk & Kimball

[57] ABSTRACT

The disclosed invention relates to a single hoist line operated clamshell bucket apparatus and method of use. The bucket apparatus is loaded in the usual manner at a first location for transporting bulk material to a second location where it is discharged. The bucket is discharged by sensing the presence of a preselected radio command signal that is controlled by the crane operator. The sensed radio signal operates a shut-off valve in a hydraulic controlled bucket latching system to release hydraulic fluid to permit discharge of the clamshell bucket.

17 Claims, 4 Drawing Figures

Fig. 1
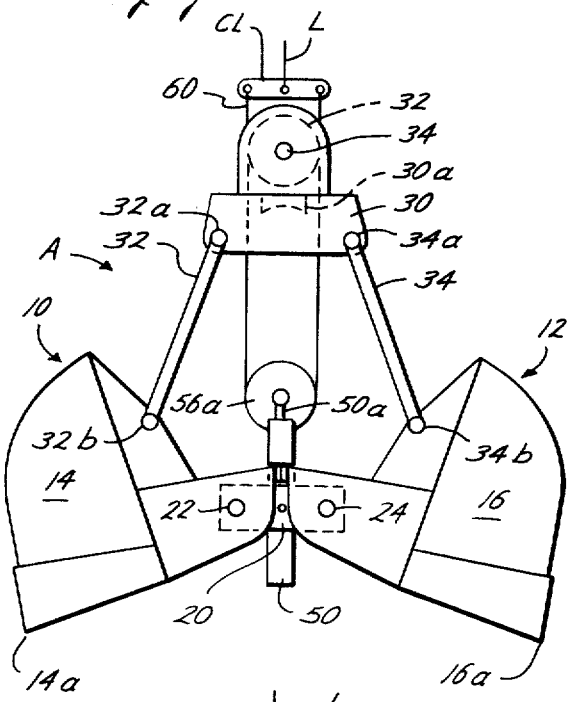
Fig. 2
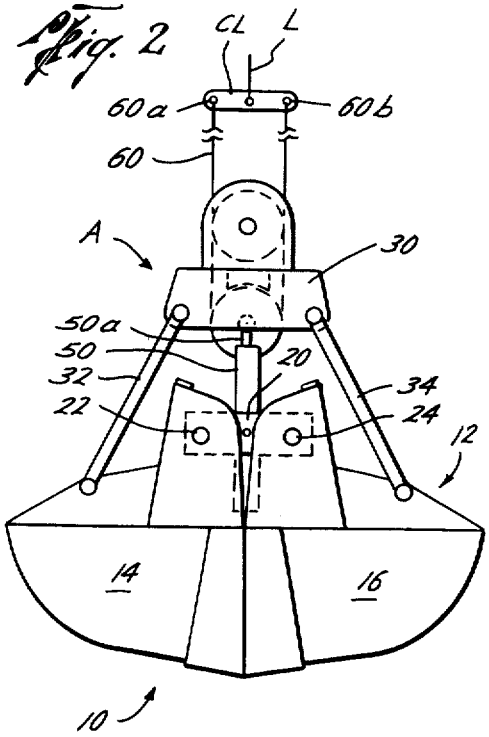
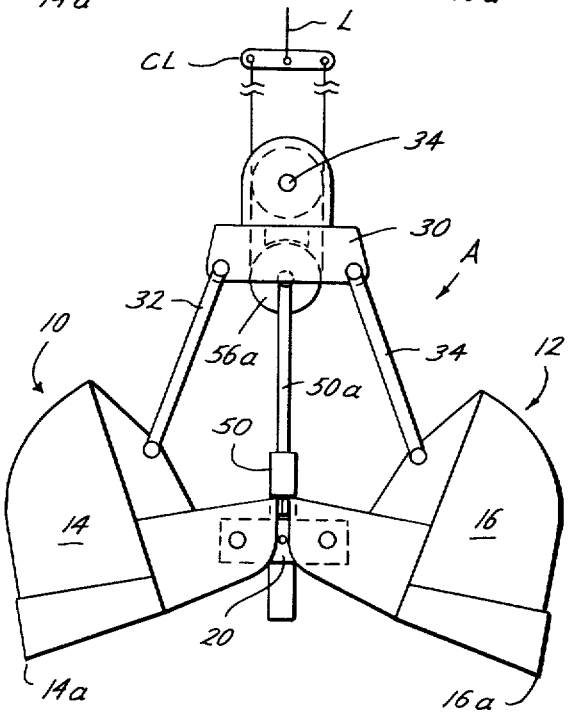
Fig. 3
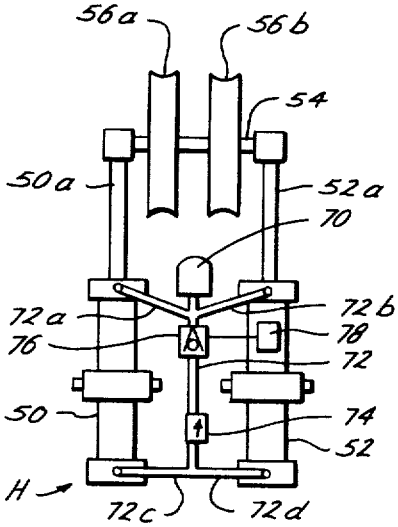
Fig. 4

REMOTE CONTROLLED CLAMSHELL BUCKET APPARATUS AND METHOD OF USING SAME

TECHNICAL FIELD

The present invention relates to the technical field of clamshell buckets for transporting bulk material and in particular to single hoist line operated clamshell buckets.

Single hoist line automatically operated clamshell buckets have achieved widespread acceptance for loading and unloading large quantities of bulk materials. Examples of such bulk material transported by such clamshell buckets include fertilizers, coal, grains and the like, but such examples should not be considered a limitation on the use of the present invention. The economy of essentially automatic operation of such single line operated buckets have contributed significantly to their widespread acceptance when marine vessels, such as a ship or barge, are involved. The large expense incurred while a ship or barge is docked for loading or unloading a bulk material cargo has made such economical and convenient cargo handling equipment extremely desirable. It should be understood that the use of the present invention is also not in any way limited to marine applications, but that the many advantages of this type of equipment make is especially attractive for such use.

BACKGROUND ART

U.S. Pat. Nos. 3,934,917 and 4,174,131, both of which are assigned to the assignee of the present invention, disclose single hoist line operated clamshell buckets for handling bulk materials. Such buckets are automatically operated open or closed by either the presence or absence of tension in the single hoist line for the bucket. Bucket loading with the bulk material automatically occurs when the hoist line is tightened with the buckets supported on the bulk material. To discharge a full bucket, it was only necessary to lower the bucket until the bucket weight was removed from the hoist line in order that the hoist line would slack off sufficiently for the mechanical closing latch to release. The necessity to lower the bucket onto a support surface to remove the weight from the buckets and hoist line to discharge the buckets was a time consuming step that significantly increased cargo transfer time. Another method involved manual tripping in the air of the bucket release mechanism by means of a rope or line attachment. This operation involved additional personnel, risk of injury and a clumsy operational sequence.

The mechanically operated latching mechanism was also subject to fatigue failure from the repeated latching and releasing operation of the buckets. A number of improvements to overcome the problems associated with the wear of or damage to the buckets latch and release mechanisms have been made. One such improvement was disclosed in U.S. Pat. No. 4,043,580 which employed a remotely actuated hydraulic operating cylinder in conjunction with the mechanical latching mechanism. In one disclosed embodiment a radio controlled valve is used in conjunction with a limit switch to control discharge of the clamshell bucket.

SUMMARY OF THE INVENTION

In accordance with the present invention, a new and improved single hoist line clamshell bucket apparatus and method of use are provided. When loading, the bucket apparatus employs a hydraulic fluid system for automatically latching or holding the buckets in the closed position for transferring the bulk material. Upon receipt of a prearranged radio signal by the wireless signal receiver, a hydraulic valve is activated to release contained hydraulic fluid within an operating cylinder for enabling the buckets to open and discharge the bulk material in a controlled manner. The telescoping action of the hydraulic operating cylinders also serve as shock absorbers or dampeners for reducing the effect of impact loading as the bucket apparatus. The clamshell buckets enhanced method of operation using the wireless signal receiver to effect remote hydraulic release to discharge the transferred material from the buckets to provide a faster operating or material transfer sequence is set forth.

BRIEF DESCRIPTION OF THE DRAWINGS

FIG. 1 is a side view of the clamshell bucket apparatus of the present invention in the open position during the initial step of the bulk material loading sequence of use of the apparatus.

FIG. 2 is a view similar to FIG. 1 with the apparatus operated to the closed position and in the loaded condition for transporting the loaded bulk material;

FIG. 3 is a view similar to FIG. 1 with the apparatus in the open position immediately after discharge of the transferred bulk material; and FIG. 4 is a detailed schematic view of the arrangement hydraulic operating system of the clamshell bucket apparatus.

BEST MODE FOR CARRYING OUT THE INVENTION

The clamshell bucket apparatus of the present invention, generally designated A in the Figs. is preferably used or employed in an improved method of use for transfering bulk material from a first location to a second location. The transferred bulk material may be any suitable substance that can be effectively handled by the apparatus A. Usually, the bulk material will be coal, grain, sand, chemicals, fertilizer or the like, but almost any material having similar handling properties may be transferred if desired and the type or properties of the transferred material should not be considered as limiting the present invention in any manner.

The clamshell bucket apparatus A is usually connected to a hoisting apparatus crane (not illustrated) or the like for selectively supporting and moving the apparatus A to and from the first and second locations for transfering the bulk material in the well known manner. A single operating and hoist support line L is secured to extend from the bucket apparatus A to the winch drum of the operating crane in the usual manner.

As illustrated in FIG. 1, the clamshell bucket apparatus A includes a pair of moveably connected clamshell bucket assemblies generally designated 10 and 12. Each of the clamshell bucket assemblies is provided with a scoop section 14 and 16 respectively, and which are substantially mirror images of each other in construction and the written description of one is equally applicable to the other. For this reason, only the clamshell bucket assembly 10 and scoop section 14 will be described in detail, but with the understanding that such description is equally applicable to the clamshell bucket assembly 12 and scoop section 16 in light of the aforementioned difference.

The clamshell bucket scoop section 14 forms a portion of a material carrying receiver or container terminating with a material engaging closing edge 14*a*. When the bucket assemblies 10 and 12 are in the open position as illustrated in FIG. 1, the closing edges 14*a* and 14*a* of the scoop sections 14 and 16, respectively, are disposed a preselected distance apart for discharging the transferred material from the bucket apparatus A. The bucket assemblies 10 and 12 are relatively moveable to each other to and from the open position illustrated in FIG. 1 with the closing edges 14*a* and 16*a* spaced apart to empty or enabling filling of the apparatus and the closed position as illustrated in FIG. 2 with the closing edges 14*a* and 16*a* and the bucket assemblies 10 and 12 in a juxtaposed relationship. In the closed position, the bucket assemblies 10 and 12 form or provide the material receiver with the movable scoop sections 14 and 16 for carrying or supporting the bulk material being transported in the usual manner.

A bucket link pivot connector member 20 is provided with a first pivot pin 22 for pivotally connecting with the scoop section 14 of the bucket assembly 10. A similar second pivot pin 24 movably secures the member 20 with the scoop section 16 to provide for the relative operating pivot movement when opening and closing the pair of clamshell bucket assemblies 10 and 12.

A movable upper bucket connector member 30 is mounted with the scoop section 14 by a first connecting member or link 32 that is pivotally connected to the upper connector member 30 at 32*a* and similarly pivotally connected with the clamshell scoop section 14 at 32*b*. A similar link 34 pivotally connects the scoop section 16 with the upper connector member 30 in a similar manner. When the upper movable bucket connector 30 is moved upwardly to the expanded position away from the lower bucket connector 20 as illustrated in FIGS. 1 and 3, the scoop sections 14 and 16 are moved to the open position. When the connectors 30 and 20 are positioned in relatively close proximity or the contracted position illustrated in FIG. 2, the scoop sections 14 and 16 are moved to the closed or loaded position.

Secured to the upper connector member 30 is the upper operating sheave or pulley 32 that is rotatably mounted to an upwardly projecting extension 30*a* of the upper bucket connector 30 by a pivot pin 34. While a single pulley or sheave 32 is illustrated, those skilled in the art will immediately appreciate that a plurality of pulleys or sheaves may be employed if desired by those skilled in the art.

Mounted with the lower bucket connector member 20 is a pair of hydraulic operator cylinders 50 and 52 that are illustrated in FIG. 1 and operably connected in FIG. 4. Extending from the operating cylinders 50 and 52 in the usual manner are movable piston rods 50*a* and 52*a* which mount therebetween a lower pulley pivot pin 54 having operating cable pulleys 56*a* and 56*b*, respectively, rotatably mounted thereon for operably receiving a working cable thereon. Connected to a cable connector link CL is the clamshell bucket apparatus operating cable 60 having opposite ends fixed to the connector links CL at 60*a* and 60*b* respectively. The cable 60 is secured over the operating pulleys or sheaves 32 and 56*a* and 56*b* in the usual manner as indicated and more fully described in the mentioned and incorporated herein patents. The connection of the cable 60 about the pulleys 32 and 56*a* is also illustrated, partially in phantom, in FIGS. 1, 2 and 3.

Mounted with the clamshell bucket assemblies 10 and 12 is the hydraulic operating or releasable latching system, which is generally indicated as H in FIG. 4 which includes the previously mentioned hydraulic operating cylinders 50 and 52. An enclosed gravity fed hydraulic fluid supply reservoir 70 is connected to a central hydraulic operating tube conduit 72 which is in turn connected by parallel branch conduits 72*a* and 72*b* with the upper ends of the hydraulic cylinders 50 and 52 having the protruding piston rods 50*a* and 52*a*, respectively. Similar branch conduits 72*c* and 72*d* communicate in a similar manner with the bottom or other end of the operating cylinders 50 and 52 in the usual manner. The parallel type hydraulic connection of the operating cylinder 50 and 52 will enable additional cylinders to be used if desired. A one flow direction orifice flow metering valve 74 is located in the conduit 72 immediately above the branch conduits 72*c* and 72*d* for controlling the rate of hydraulic fluid flow in the conduit 72 to dampen or retard operation of the cylinders 50 and 52. The operating cylinders 50 and 52 and orifice valve 74 provide a hydraulically dampered telescoping action of the pulley sheaves and bucket movement and which can be selectively rendered inactive if desired. A radio control shut-off valve 76 actuated or operated by a wireless operating receiver 78 also controls flow through the conduit 72. When the receiver 78 senses the presence of the radio control signal, the shut-off valve 76 is moved to the open position for enabling flow through the conduit 72 and the metering valve 74. In the absence of such a radio control signal 76, the normally closed valve 76 remains closed and does not enable passage of fluid flow in the conduit 72 and which also contains the hydraulic fluid in the operating cylinders 50 and 52 respectively to hold the piston rods 50*a* and 52*a* in the same position by the trapped or contained incompressible hydraulic fluid. The radio control receiver 78 is preferably battery powered in a self-contained unit to provide sufficient electrical power for operation of the receiver 78 and shut-off valve 76 for extended operating periods. If desired, the shut-off valve 76 may be constructed to alternate between open and closed positions upon sensing of the radio signal.

While the preferred embodiment employs a radio controlled actuated bucket discharge to enable mid-air emptying of the apparatus A, it is to be understood that other arrangements may be employed to effect bucket release to empty the clamshell bucket apparatus. For example, a pressure sensing switch may be located on the lower portion of a scoop section to actuate hydraulic release in an operating manner akin to the mechanical release discharge operation of the apparatus disclosed in the patents incorporated herein by reference.

USE AND OPERATION

In the use and operation of the present invention, the bucket apparatus A is assembled in the manner illustrated and the connecting link CL of the bucket apparatus A of the present invention is connected to the operating hoist line L of the associated crane or operating device in the usual manner. Initially the bucket apparatus A may be in the open position as illustrated in FIG. 1, the closed position illustrated in FIG. 2 or the open position with the hydraulic cylinder piston rods extended as illustrated in FIG. 3. However, the condition illustrated in FIG. 3 will not be the usual starting position due to the effect of gravity compressing the piston rods 50*a* and 52*a* as will become apparent from the disclosure of use hereinbelow. This is fortunate in that the piston rods 50*a* and 52*a* must be retracted into and locked in the operating cylinders 50 and 52, before normal bucket closing or loading will occur.

Upon the initial tensioning or tightening of the hoist line L, the operating line 60 will move the pulleys 32 and 56*a* and 56*b* from the extended position of FIG. 1 to the relative close proximity position with the scoop sections 14 and 16 remaining in the open position as illustrated in FIG. 3. In the event that the scoop sections 14 and 16 are in the closed position of FIG. 2, only a tightening of the bucket operating cable 60 will occur prior to elevating the apparatus A.

With the pulleys 32 and 56*a* and 56*b* in the relative close position illustrated in FIG. 3, continued lifting will not effect closing operation of the scoop sections 14 and 16. However, if the apparatus A is again lowered where it will be supported on the bulk material to be transferred or other surface, the piston rods 50*a* and 52*a* will be gravity forced by the weight of the upper connector link 30 to move into the operating cylinders 50 and 52 if the shut-off valve 76 is open. This change in piston rod 50*a* and 52*a* positions is illustrated by the change from the condition of FIG. 3 to that of FIG. 2. While the piston rods 50*a* and 52*a* are moving into the cylinders 50 and 52, the clamshell bucket sections 14 and 16 remain in the open position. Thereafter, further tightening of the hoist line L would effect movement of the bucket connectors 20 and 30 together to produce movement of the bucket sections 14 and 16 to the closed position illustrated in FIG. 2 by shortening the distance between the pulleys 32 and 56*a* and 56*b* with cable 60. This step, of course, would be identical to the usual or customary loading step for the single line clamshell bucket apparatus A if it was positioned on the bulk material to be loaded. The hoist line L would then elevate or hoist the loaded clamshell bucket apparatus A and affect its movement to the desired location for discharge.

When the desired position of the clamshell bucket apparatus A for discharge is reached, a preselected radio or wireless signal is actuated or transmitted by the crane operator (not illustrated). Such preselected signal will be sensed by the receiver 78 which will affect the opening of the shut-off valve 76. Opening of the valve 76 will enable flow of the hydraulic fluid trapped in the operating cylinders 50 and 52 and enable the piston rods 50*a* and 52 to move to the extended position illustrated in FIG. 3 in a controlled manner due to the restricted flow through orifice metering valve 74. Such extension will move the bucket sections 14 and 16 to the open position with the closing edges 14*a* and 16*a* spaced apart for discharging the loaded bulk material in the clamshell bulk apparatus A.

The automatic closing and opening sequence of operation of the clamshell bucket apparatus A may be repeated until the entire cargo or load of bulk material is transfered in the usual manner.

During the normal loading sequence, the crane operation will lower the bucket apparatus 10 in the open position (FIG. 3). When the bucket apparatus is set on or supported on the bulk material to be transported, the crane operator will continue to lower the connector link CL and pulley sheaves 56*a* and 56*b*. This latter movement enables the piston rods 50*a* and 52*a* to retract into the associated operating cylinders 50 and 52, respectively. The operator then effects closing action of the shut-off valve 76 in the prearranged manner, such as by terminating emission of the radio signal to the receiver 78 or a signal that closes the valve 76. This closes the valve 76, locks the hydraulic system and prevents movement of piston rods 50*a* and 52*a* in the operating cylinders 50 and 52, respectively. This also locks the pulley sheaves 56*a* and 56*b* closely adjacent the lower connector link 20 in order that subsequent tightening of the operating cable 60 by the hoist line L will operate the bucket sections 14 and 16 to the closed position for loading the bucket apparatus A.

The foregoing disclosure and description of the invention are illustrative and explanatory thereof, and various changes in the size, shape and materials as well as in the details of the illustrated construction may be made without departing from the spirit of the invention.

I claim:

1. A clamshell bucket apparatus adapted for transporting bulk material from a first location to a second desired location using a single hoist support line including:

a pair of movably connected clamshell bucket assemblies, each of said assemblies having a scoop section forming a closing edge, said assemblies being relatively movable to each other between an open position placing said closing edges a preselected distance apart and a closed position with said closing edges located in juxtaposed relationship for forming a receiver with said scoop sections for the bulk material being transported;

means operably connected with said pair of clamshell bucket assemblies for operating and manipulating said clamshell bucket assemblies to transport the bulk material to the desired location, said means for operating and manipulating comprising:

a single hoist support line system adapted to extend from the clamshell bucket apparatus to a crane or the like for selectively supporting the apparatus;

a hydraulic operating system with said clamshell bucket assemblies and connected with said single hoist support line system for releasably holding said clamshell bucket assemblies in the closed position to transport the bulk material, said hydraulic operating system having a normally closed controlled discharge valve for enabling a desired flow of hydraulic fluid to release said clamshell bucket assemblies for movement from the closed position to the open position for discharging the transported bulk material at the second location;

said normally closed controlled discharge valve being operable to block the flow of hydraulic fluid and to lock said hydraulic operating system relative to said single hoist support line system whereby when the single hoist line is tensioned said clamshell bucket assemblies automatically move to the closed position for forming the receiver for the bulk material; and radiant energy signal receiver means associated with said normally closed controlled discharge valve for controlled actuation of said discharge valve to release said clamshell bucket assemblies when the presence of a preselected radiant energy signal is sensed by said radiant energy signal receiver means.

2. The apparatus as set forth in claim 1, wherein said hydraulic operating system including an operating cylinder means having a moveable piston means disposed therein, said piston means having a portion extending from said operating cylinder means for operable connection with said single hoist support line system;

said operating cylinder means having a portion for operable connection with said clamshell bucket assemblies;

said normally closed controlled discharge valve containing hydraulic fluid in said operating cylinder means to operably control movement of said piston means in said operating cylinder means, said normally closed controlled discharge valve being operable to release the contained hydraulic fluid from said operating cylinder means to enable said piston means and said portion extending from said cylinder means to move to release said clamshell bucket assemblies; and said normally closed controlled discharge valve being operable to block the hydraulic fluid in said operating cylinder means to lock said piston means and said portion extending from said cylinder means to lock said operating cylinder means relative to said single hoist support line system whereby when the single hoist line is tensioned said clamshell bucket assemblies automatically move to the closed position to form the receiver for bulk material.

3. The apparatus as set forth in claim 2, wherein:

said controlled discharge valve arranged to be normally closed to prevent flow of hydraulic fluid, said controlled discharge valve actuated to the open position by said receiver means sensing the preselected radiant energy signal.

4. The apparatus as set forth in claim 2, wherein:

said hydraulic operating system having an orifice valve to restrict the flow of hydraulic fluid to and from said operating cylinder means to retard movement of said piston means.

5. The apparatus as set forth in claim 2, wherein:

said operating cylinder means including a plurality of operating cylinders connected in hydraulic parallel relationship.

6. A clamshell bucket apparatus adapted for transporting bulk material from a first location to a second desired location using a single hoist support and operating line including:

a pair of movably connected clamshell bucket assemblies, each of said assemblies having a scoop section forming a closing edge, said assemblies being relatively movable to each other between an open position placing said closing edges a preselected distance apart and a closed position with said closing edges located in juxtaposed relationship for forming a receiver with said scoop sections for the bulk material being transported;

means operably connected with said pair of clamshell bucket assemblies for operating and manipulating said clamshell bucket assemblies to transport the bulk material to the desired location, said means for operating and manipulating comprising:

a single hoist support line system adapted to extend from the clamshell bucket apparatus to a crane or the like for selectively supporting the apparatus;

a hydraulic operating system with said clamshell bucket assemblies and connected with said single hoist support line system for releasably holding said clamshell bucket assemblies in the closed position to transport the bulk material, said hydraulic operating system having a controlled discharge valve for enabling a desired flow of hydraulic fluid to release said clamshell bucket assemblies for movement from the closed position to the open position for discharging the transported bulk material at the second location; and said controlled discharge valve being operable to block the flow of hydraulic fluid in said hydraulic operating system to lock said hydraulic system relative to said single hoist support line system whereby when said single hoist line is tensioned said clamshell bucket assemblies move to the closed position for forming said receiver for bulk material.

7. The apparatus as set forth in claim 6, wherein:

said controlled discharge valve is normally closed to block flow and is moved to the open position for enabling flow of hydraulic fluid to release said clamshell bucket assemblies when said means for controlled actuation is actuated.

8. The apparatus as set forth in claim 6, further including:

radiant energy signal receiver means associated with said controlled discharge valve for controlled actuation of said controlled discharge valve to release said clamshell bucket assemblies when the presence of a preselected radiant energy signal is sensed by said radiant energy signal receiver means.

9. The apparatus as set forth in claim 6, wherein:

said hydraulic operating system including an operating cylinder means having a movable piston means disposed therein, said piston means having a portion extending from said operating cylinder means for operable connection with said single hoist support line system; and said controlled discharge valve being operable to contain the hydraulic fluid in said operating cylinder means and to lock said piston means and said portion extending from said operating cylinder means relative to said single hoist support line system whereby when the single hoist line is tensioned said clamshell bucket assemblies automatically move to the closed position to form said receiver for bulk material.

10. A clamshell bucket apparatus adapted for transporting bulk material from a first location to a second desired location using a single hoist support and operating line including:

a pair of movably connected clamshell bucket assemblies, each of said assemblies having a scoop section forming a closing edge, said assemblies being relatively movable to each other between an open position placing said closing edges a preselected distance apart and a closed position with said closing edges located in juxtaposed relationship for forming a receiver with said scoop sections for the bulk material being transported;

means operably connected with said pair of clamshell bucket assemblies for operating and manipulating said clamshell bucket assemblies to transport the bulk material to the desired location, said means for operating and manipulating comprising:

a single hoist support line system adapted to extend from the clamshell bucket apparatus to a crane or the like for selectively supporting the apparatus;

a hydraulic operating system with said clamshell bucket assemblies and connected with said single hoist support line system for releasably holding said clamshell bucket assemblies in the closed position to transport the bulk material, said hydraulic operating system including an operating cylinder means having a movable piston means disposed therein, said piston means having a portion extending from said operating cylinder means for operable connection with said single hoist support line system, said hydraulic operating system having a normally closed controlled discharge valve for enabling a desired flow of hydraulic fluid from said operating cylinder means to release said clamshell bucket assemblies for gravity movement from the closed position to the open position for discharging the transported bulk material at the second location and said normally closed controlled discharge valve for blocking the flow of hydraulic fluid from said operating cylinder means to lock said movable piston means and said operating cylinder means relative to said single hoist support line system whereby when the single hoist is tensioned said clamshell bucket assemblies are moved to the closed position for forming said receiver for bulk material; and radio energy signal receiver means associated with said normally closed controlled discharge valve for controlled actuation of said discharge valve to the open position to release said clamshell bucket assemblies when the presence of a preselected radio energy signal is sensed by said radio energy signal receiver means.

11. A method of operating a single hoist support and operating line clamshell bucket apparatus for transporting bulk material from a first location to a second location, including the steps of:

loading the bucket apparatus with material to be transported at the first location, said loading including the steps of:

supporting the clamshell bucket apparatus in an open position on the bulk material;

blocking the flow of hydraulic fluid in an operating cylinder with the clamshell bucket apparatus to lock said operating cylinder relative to the clamshell bucket apparatus;

tensioning the single hoist line connected to the clamshell bucket apparatus to position the clamshell bucket apparatus in a closed position for loading the bulk material in a receiver thereformed;

moving the loaded bucket apparatus using the single hoist support and operating line to a position adjacent the second location suitable for discharge of the bucket apparatus;

transmitting a preselected radio signal when the clamshell bucket apparatus is suitably positioned for discharge of the bulk material;

sensing the preselected radio signal with a receiver mounted on the clamshell bucket apparatus; and actuating the clamshell bucket apparatus to discharge the transported bulk material in response to the preselected radio signal.

12. The method as set forth in claim 11, wherein:

the step of actuating includes the step of enabling flow of contained hydraulic fluid from an operating cylinder to discharge the transported bulk material.

13. The method as set forth in claim 12, wherein:

the step of enabling flow includes the step of opening a shut-off valve for enabling the flow of contained hydraulic fluid.

14. The method as set forth in claim 13, wherein:

the step of enabling flow includes the step of directing the flow of contained hydraulic fluid through an orifice to dampen operation of the operating cylinder to discharge the transported bulk material.

15. The method as set forth in claim 11, wherein the step of supporting includes the steps of:

enabling flow of hydraulic fluid from said operating cylinder; and slackening the single hoist support line for gravity forcing a piston connected with the single hoist support line into said operating cylinder.

16. The method as set forth in claim 15 wherein: the step of enabling flow includes the step of:

opening a shut-off valve for enabling the flow of contained hydraulic fluid.

17. The method as set forth in claim 15 wherein the step of containing the flow of hydraulic fluid includes the steps of:

closing a shut-off valve for containing the flow of hydraulic fluid in said operating cylinder; and locking said piston relative to the clamshell bucket apparatus.

* * * * *